US012345476B2

(12) United States Patent
Gaibler et al.

(10) Patent No.: US 12,345,476 B2
(45) Date of Patent: Jul. 1, 2025

(54) TUBE BUNDLE HEAT EXCHANGER

(71) Applicant: WIELAND-WERKE AG, Ulm (DE)

(72) Inventors: Harald Gaibler, Rottenacker (DE); Achim Gotterbarm, Dornstadt (DE); Philipp Hofmann, Weissenhorn (DE); Verena Obst, Neu-Ulm (DE); Michael Scheuss, Cologne (DE)

(73) Assignee: WIELAND-WERKE AG, Ulm (DE)

( * ) Notice: Subject to any disclaimer, the term of this patent is extended or adjusted under 35 U.S.C. 154(b) by 224 days.

(21) Appl. No.: 18/246,410

(22) PCT Filed: Oct. 21, 2021

(86) PCT No.: PCT/EP2021/000127
§ 371 (c)(1),
(2) Date: Mar. 23, 2023

(87) PCT Pub. No.: WO2022/106045
PCT Pub. Date: May 27, 2022

(65) Prior Publication Data

US 2023/0392871 A1 Dec. 7, 2023

(30) Foreign Application Priority Data

Nov. 17, 2020 (DE) ..... 10 2020 007 022.1

(51) Int. Cl.
*F28D 7/16* (2006.01)
*F28F 1/36* (2006.01)
(Continued)

(52) U.S. Cl.
CPC ..... *F28D 7/16* (2013.01); *F28F 1/36* (2013.01); *F28F 9/162* (2013.01); *F28F 9/18* (2013.01);
(Continued)

(58) Field of Classification Search
CPC ..... F28D 7/16; F28F 1/36; F28F 9/162; F28F 9/18; F28F 2275/02; F28F 2275/04; F28F 2275/06; F28F 2275/067
See application file for complete search history.

(56) References Cited

U.S. PATENT DOCUMENTS 2,862,693 A * 12/1958 Tinker ..... F28F 9/0138 165/172
3,823,464 A * 7/1974 Chartet ..... B21D 39/06 228/136
(Continued)

FOREIGN PATENT DOCUMENTS

CN 105209211 A 12/2015
DE 2059122 6/1971
(Continued)

OTHER PUBLICATIONS

International Search Report with English Translation issued in corresponding International Application No. PCT/EP2021/000127 date of mailing Mar. 1, 2022 (6 pages).
(Continued)

*Primary Examiner* — Eric S Ruppert
*Assistant Examiner* — Hans R Weiland
(74) *Attorney, Agent, or Firm* — FLYNN THIEL, P.C.

(57) ABSTRACT

A tube bundle heat exchanger having a tube sheet, an outer shell and an interior. The heat exchanger includes a tube bundle having tubes located in the interior for fluid flow. The tubes have outside ribs and a channel is formed between adjacent ribs. The tube sheet has openings as passage points. Outer fins of the tubes project into the openings, and a joint gap is formed between an inner surface defining the opening and the outer fins of a tube located therein. The tubes are bonded to the tube sheet by joining material with the involvement of the outer fins. The bond is only formed in a first portion of the opening. The first portion is filled with
(Continued)

joining material such that a second portion of the opening remains which is not filled with joining material, and the tube has outer fins adjacent the second portion.

8 Claims, 2 Drawing Sheets

(51) Int. Cl.
*F28F 9/16* (2006.01)
*F28F 9/18* (2006.01)

(52) U.S. Cl.
CPC ..... *F28F 2275/02* (2013.01); *F28F 2275/067* (2013.01)

(56) References Cited

U.S. PATENT DOCUMENTS

| | | | | |
|---|---|---|---|---|
| 4,749,031 | A * | 6/1988 | Fukumoto | F28F 21/062 165/184 |
| 2002/0162651 | A1* | 11/2002 | Nakagome | F02M 26/32 165/158 |
| 2008/0235950 | A1 | 10/2008 | Thors et al. | |
| 2009/0166019 | A1 | 7/2009 | Tokizaki et al. | |
| 2013/0037601 | A1* | 2/2013 | Eller | B23K 37/0536 228/101 |
| 2014/0262173 | A1 | 9/2014 | Nagurny et al. | |
| 2018/0372427 | A1 | 12/2018 | Rottoli et al. | |

FOREIGN PATENT DOCUMENTS

| | | | |
|---|---|---|---|
| DE | 102006031606 | A1 | 1/2008 |
| DE | 102008062486 | A1 | 7/2009 |
| DE | 102008020946 | A1 | 10/2009 |
| EP | 2331900 | B1 | 6/2011 |
| JP | 51117270 | | 9/1976 |
| JP | 2001342909 | A | 12/2001 |
| JP | 5199857 | | 5/2013 |
| WO | 2017025184 | A1 | 2/2017 |
| WO | 2017125253 | A1 | 7/2017 |

OTHER PUBLICATIONS

Written Opinion of International Searching Authority issued in corresponding International Application No. PCT/EP2021/000127 dated Mar. 1, 2022 (5 pages).
German Office Action issued in corresponding German Application No. 10 2020 007 022.1 date of mailing May 31, 2021 (7 pages).
Notice of Reasons for Refusal, with English translation, issued in corresponding Japanese Application No. 2023-522815 dated May 6, 2024 (8 pages).
English translation of Taiwan Search Report, issued in corresponding Taiwan Application No. 110139129, dated Dec. 2024 (1 page).

* cited by examiner

TUBE BUNDLE HEAT EXCHANGER

TECHNICAL FIELD

The invention relates to a tube bundle heat exchanger.

BACKGROUND AND SUMMARY

Tube bundle heat exchangers serve to transfer heat from a first fluid to a second fluid. For this purpose, a tube bundle heat exchanger in most cases has a hollow cylinder in the interior of which a plurality of tubes is arranged. One of the two fluids can be guided through the tubes, the other fluid can be guided through the hollow cylinder, in particular around the tubes. The tubes are fastened at their ends to a tubesheet or to a plurality of tubesheets of the tube bundle heat exchanger along its circumference. In the course of the process of producing a tube bundle heat exchanger, the tubes are connected by their ends to the tubesheet by a material-bonded connection, for example. It is generally desirable to provide a possible way of connecting tubes of a tube bundle heat exchanger to a tubesheet of the tube bundle heat exchanger in a manner that involves little effort and is inexpensive and that achieves high quality.

A method for connecting tubes of a tube bundle heat exchanger to a tubesheet is described in publication WO 2017/025 184 A1. The tubes and the tubesheet are each made of aluminum or an aluminum alloy and are connected to the tubesheet by a material-bonded connection by means of laser welding. The intensity of the laser beam that is produced is here over 1 MW/cm2. It is also envisaged that the tubes of the tube bundle heat exchanger are connected to the tubesheet in a form-fitting manner prior to the laser welding.

The tube bundle heat exchanger to be produced has in its finished, operational state a plurality of tubes which are arranged in the interior of a hollow cylinder. The tubesheet can be in the form of a plate and has holes which correspond in diameter substantially to the outside diameters of the tubes. Each tube is fastened at one of its ends to one of these holes.

The tubes can run straight inside the hollow cylinder as a straight-tube heat exchanger. In this case, two tubesheets are provided, which are arranged at opposite ends of the straight-tube heat exchanger. Each tube is fastened at one of its ends to one of these two tubesheets.

The tubes can also run in a U-shape inside the hollow cylinder as a U-tube heat exchanger. Such a U-tube heat exchanger usually has only one tubesheet. Since the tubes in this case are bent in a U-shape, they can each be fastened at both their ends to the same tubesheet.

DE 10 2006 031 606 A1 discloses a method for the laser welding of a heat exchanger for exhaust gas cooling, in which an oscillating movement is additionally superimposed on a feed movement of the laser beam. This oscillating movement takes place substantially in the perpendicular direction to the feed direction. The oscillating movement is carried out for reasons of better bridging of gaps.

Furthermore, publication WO 2017/125 253 A1 discloses a method for connecting tubes of a tube bundle heat exchanger to a tubesheet. The tubes are connected to the tubesheet by a material-bonded connection by means of laser welding. For the connection, a laser beam is generated and focused onto a point that is to be welded in a connection region between a tube and the tubesheet. The laser beam is here moved in such a way that it performs a first movement over the connection region and a second movement which is superimposed on the first movement and is different from the first movement. By means of the second movement, the melt bath dynamics is purposively influenced and a vapor capillary that forms is advantageously modified.

One object underlying the invention is to reliably connect tubes of a tube bundle heat exchanger to a tubesheet in manner that involves little effort and achieves high quality.

One aspect of the invention includes a tube bundle heat exchanger having an enveloping outer shell and at least one tubesheet, which together define an interior of the tube bundle heat exchanger. The tube bundle heat exchanger comprises a tube bundle having a plurality of heat exchanger tubes which are arranged in the interior and through which a first fluid can flow, and which are optionally supported by additional support plates. The heat exchanger tubes have helically circumferential integral fins which are formed on the outside of the tubes and have a fin foot, fin flanks and a fin tip, and a channel having a channel bottom is formed between the fins. The tube bundle heat exchanger comprises at least one inlet at the outer shell, by way of which a second fluid can be introduced into the interior, and at least one outlet, by way of which the second fluid can be discharged from the interior. The tube bundle heat exchanger optionally comprises at least one plenum box arranged at the at least one tubesheet for distributing, diverting or collecting the first fluid. The at least one tubesheet has openings as passage points, wherein each opening has an inner surface. The heat exchanger tubes project at least with their outer fins into the openings of the tubesheet, whereby a joint gap is formed in each case between the inner surface of an opening and the outer fins, located inside the opening, of a heat exchanger tube. The heat exchanger tubes, by means of joining material and with the involvement of the outer fins, have a material-bonded connection to the tubesheet, which connection is formed only in a first portion of the opening extending in an axial direction from the end face of a heat exchanger tube, in that, in this first portion, the joint gap is filled with joining material, so that a second portion of the opening remains, in which the joint gap is not filled with joining material, wherein the heat exchanger tube continues to have outer fins on the outside of the tube in the region of the second portion.

In other words, the heat exchanger tubes have outer fins inside the passage points at which they enter a tubesheet or pass through a tubesheet. These outer fins are surrounded by the material for a material-bonded connection, thus providing hermetic sealing against the passage of gas or liquid. For the pure material-bonded connection, a combination together with force-based engagement and interlocking engagement can advantageously also be used.

The joining material penetrates into the joint gap in the axial direction from the end face only to a certain degree in a first portion, since the outer fins are an obstacle to a free passage as is provided, for example, in the case of a plain tube. The outer fins consequently form barriers, around which the material must flow or which must be melted. The flow of material around the fins is of particular importance in particular in the case of the joining methods of soldering and adhesive bonding. In the case of welding, the outer fins of the heat exchanger tube are also partially melted at the end face. The melt flow is then preferably stopped at one of the outer fins as soon as the temperature of the melt is no longer sufficient to melt a fin located further inward. This barrier stops the further penetration of the melt in the joint gap. In this manner, there is a defined flow process of the joining material during the joining operation, which closes the joint completely at or in the vicinity of the end face of the tube.

In addition to the outer fins, a heat exchanger tube can optionally have an inner structure. The inner structure can be in the form of an internal circumferential helix with a given angle of twist. In the case where the outside of the heat exchanger tubes has spirally circumferential outer fins, the pitch of the circumferential outer fins can be the same as, less than or greater than the pitch, given by the angle of twist, of the circumferential helix. Consequently, the two structures can differ from one another in that, for the material-bonded connection of the outside of a heat exchanger tube to the vessel wall, the form of the outer fins and of the inner structure can be configured independently of one another and thus optimized.

However, in order to optimize the heat exchange, certain limits are specified for both structures. Thus, the ratio of the maximum structural height of the outer fins and the maximum structural height of the inner structure is preferably in the range of from 1.25 to 5 for condenser tubes and preferably in the range of from 0.5 to 2 for evaporator tubes.

Above all, investment costs are to be saved, since the tube bundle heat exchangers according to one aspect of the invention can have a substantially more compact construction. The outer fins here continue into the tubesheet, whereby the number of heat exchanger tubes per unit can be reduced significantly. Depending on requirements, the finned tubes permit more efficient energy use or allow fill quantities to be reduced, which lowers the operating costs.

One aspect of the invention proceeds from the consideration that a material-bonded connection of the heat exchanger tubes to the tubesheets is achieved particularly reliably and with little effort and with high quality. In this regard, a heat exchanger tube enters the tubesheet or passes through the tubesheet with its external outer fins. The outer fins are then retained immediately adjacent to the material-bonded connection of the tubes to the tubesheet. This has the particular advantage that, in the interior of the tube bundle heat exchanger, the heat exchanger tubes have continuous outer fins for efficient heat transfer.

In an advantageous embodiment of the invention, the first portion filled with joining material can account for less than 70% of the length of the entire joint gap in the axial direction. Advantageously, the filled first portion of the joint gap comprises only less than 50% of the total length. In particular in the case of welded connections, a degree of filling of the first portion of only 20% can be sufficient to produce a fluid-tight material-bonded connection.

Advantageously, the clear width between the fin tips of a heat exchanger tube and the inner surface of the opening can be not more than 30% of the fin height, measured from the channel bottom to the fin tip. The barrier action of the outer fins is varied by way of this clear width. In particular in the case of the joining methods of soldering and adhesive bonding, the joining material can purposively be introduced by way of this clear width of the joint gap in order to form the filled first portion. The channel formed by the helically circumferential integral fins that are formed additionally constitutes a further flow channel for the joining material. The channel cross-section is, however, given by the fin height and the spacing of adjacent fins and is usually less pronounced compared to the chosen clear width.

Advantageously, the material-bonded connection can be designed to be gas-tight and pressure-resistant. Beyond the functions in respect of mechanical stability combined with efficient heat transfer, hermetic sealing is important in any operating mode in order to prevent a fluid exchange with the surroundings.

In an advantageous embodiment of the invention, the heat exchanger tubes have a tube inside diameter D2 at the passage points which is greater than the tube inside diameter D1 of the heat exchanger tubes outside of the passage points.

If the heat exchanger tubes still have outer fins within the passage points at which they enter the tubesheet or pass through the tubesheet, this is because, in the method, the heat exchanger tube is widened, with the result that the passage inside diameter D2 is increased. As a result of a widening, the outer fins within a passage point are then squashed. Nevertheless, the material-bonded connection ensures stable hermetic sealing.

In an advantageous embodiment of the invention, the heat exchanger tubes can be soldered, adhesively bonded or welded into the tubesheet.

In addition to the mentioned preferred connection types, further connection types which reliably join the heat exchanger tubes to the tubesheet by means of a material-bonded connection can be used.

In principle, the outer fins on the outside of the heat exchanger tubes can preferably run in the circumferential direction or in the axial direction parallel to the tube axis. In an advantageous embodiment of the invention, the outside of the heat exchanger tubes can have spirally circumferential outer fins. In the case of spiral outer fins, only a residual gap and the circumferential channel extending spirally with outer fins have to be reliably sealed by the material-bonded connection.

Although a suitable uniform material is generally preferred for the heat exchanger tubes, it is possible in an advantageous embodiment of the invention for at least one first heat exchanger tube to consist of a first material and for at least one second heat exchanger tube to consist of a second material which is different from the first material. With regard to mechanical stability, steel tubes with particularly high strength can offer a particular advantage. Copper tubes, on the other hand, bring about an optimization in respect of efficient heat transfer. Other materials, such as, for example, titanium, aluminum, aluminum alloys as well as copper-nickel alloys, also come into consideration.

BRIEF DESCRIPTION OF THE DRAWINGS

Exemplary embodiments of the invention will be explained in greater detail with reference to the schematic drawings, in which.

Parts which correspond with one another are provided with the same reference signs in all the figures.

DETAILED DESCRIPTION

Figure 1:
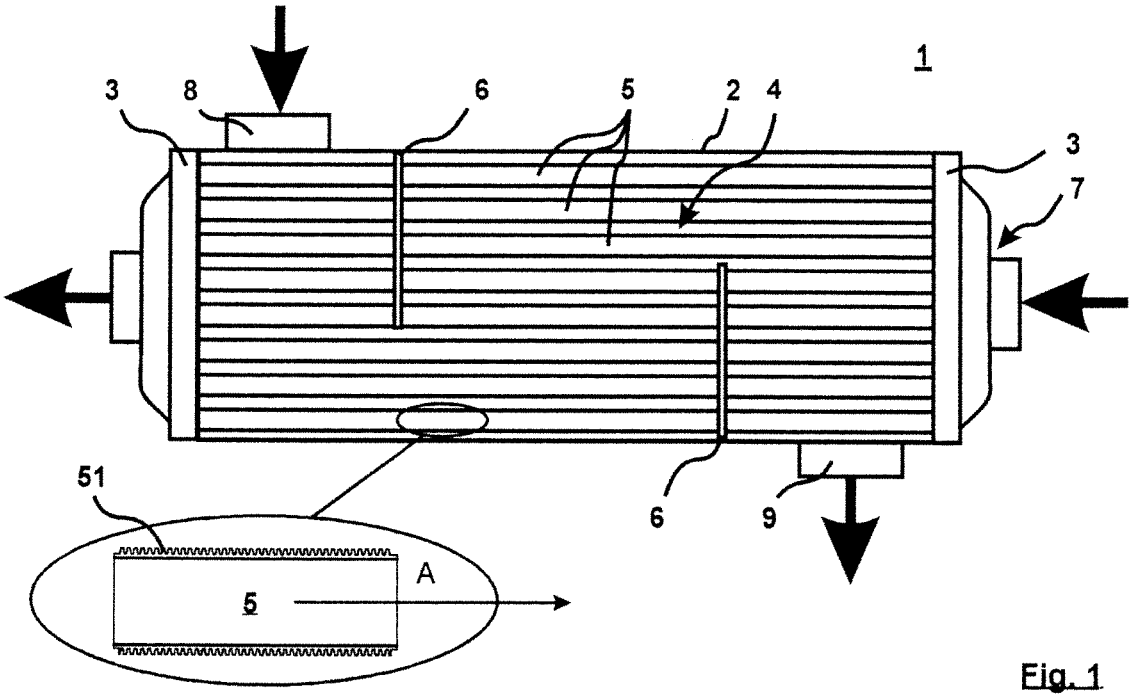
FIG. 1 shows, schematically, a side view of a tube bundle heat exchanger with a detail view of a heat exchanger tube having outer fins.

FIG. 1 shows, schematically, a side view of a tube bundle heat exchanger 1 having an enveloping outer shell 2 and two tubesheets 3, which together define an interior 4 of the tube bundle heat exchanger 1. The tube bundle heat exchanger 1 comprises a tube bundle having a plurality of heat exchanger tubes 5 which are arranged in the interior 4 and through which a first fluid for heat transfer can flow and which are supported by additional support plates 6. Such support plates 6 are often also additionally used as guide plates for the fluid flow. The tube bundle heat exchanger 1 additionally comprises plenum boxes 7, which distribute, divert or collect the first fluid in the interior of the heat exchanger tubes as required. There are provided at least one inlet 8 at the outer shell 2, by way of which inlet a second fluid for heat transfer can be introduced into the interior, and at least one outlet 9 by way of which the second fluid can be discharged from the interior. In the detail view, a heat exchanger tube 5 having outer fins 51 is magnified. By means of a rolling process which is otherwise known, integral fins 51 formed on the outside of the tube and running helically around the tube axis A are formed.

Figure 2:
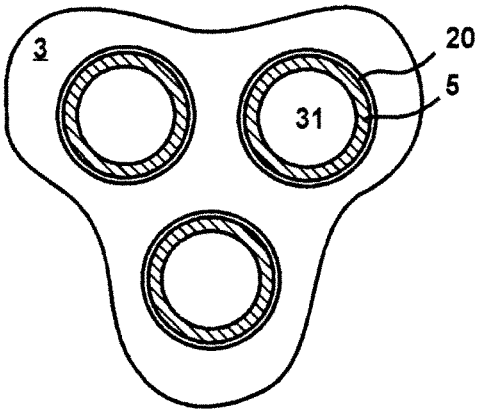
FIG. 2 shows, schematically, a front view of a detail of a tubesheet with a passage point.

FIG. 2 shows, schematically, a front view of a detail of a tubesheet 3 with passage points 31 each having an inner surface 311. At a passage point 31, the opening in the tubesheet 3 is preferably of such a size that a heat exchanger tube 5 can be introduced with its outer fins 51 into the opening and connected there by a material-bonded connection. Welded, adhesively bonded and soldered connections, as the material-bonded connection 20, can be carried out at the passage point 31, starting from the end face, over a first portion of the wall thickness of a tubesheet 3 and enter into a fluid-tight connection. In a second portion extending into the depth, a remainder, not visible in FIG. 2, of the joint gap that is not filled is retained in the tubesheet wall 3.

Figure 3:
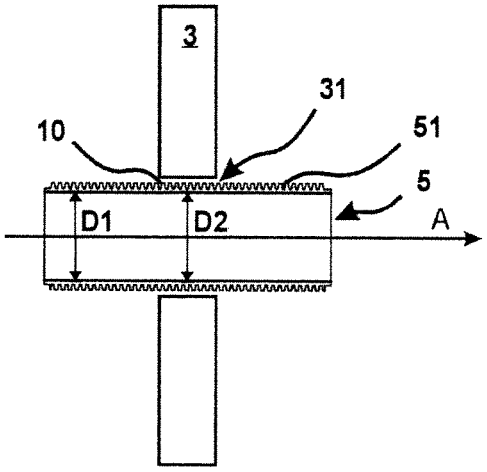
FIG. 3 shows, schematically, a perpendicular section of the tubesheet in the plane of the passage point of the heat exchanger tubes.

FIG. 3 shows, schematically, a perpendicular section of the tubesheet 3 in the plane of the passage point 31 of a heat exchanger tube 5. The heat exchanger tube 5 shown has outer fins 51 on the outside. In the exemplary embodiment shown, the heat exchanger tube 5 passes through the tubesheet 3 at the opening 31 as the passage point. At this passage point 31, the heat exchanger tube 5 has continuous outer fins 51. A material-bonded connection 20, which has not yet been made in FIG. 3, for example in the form of a continuous weld seam with the tubesheet 3 around the tube circumference, is located, after the joining operation, in a portion of the joint gap 10. Depending on the material combination of the tubesheet 3 and the heat exchanger tube 5, advantageous intermetallic new phase formations in the melt bath can occur at the weld point 20. A suitable method for producing a material-bonded connection with a locally limited melt flow is in particular laser welding.

Figure 4:
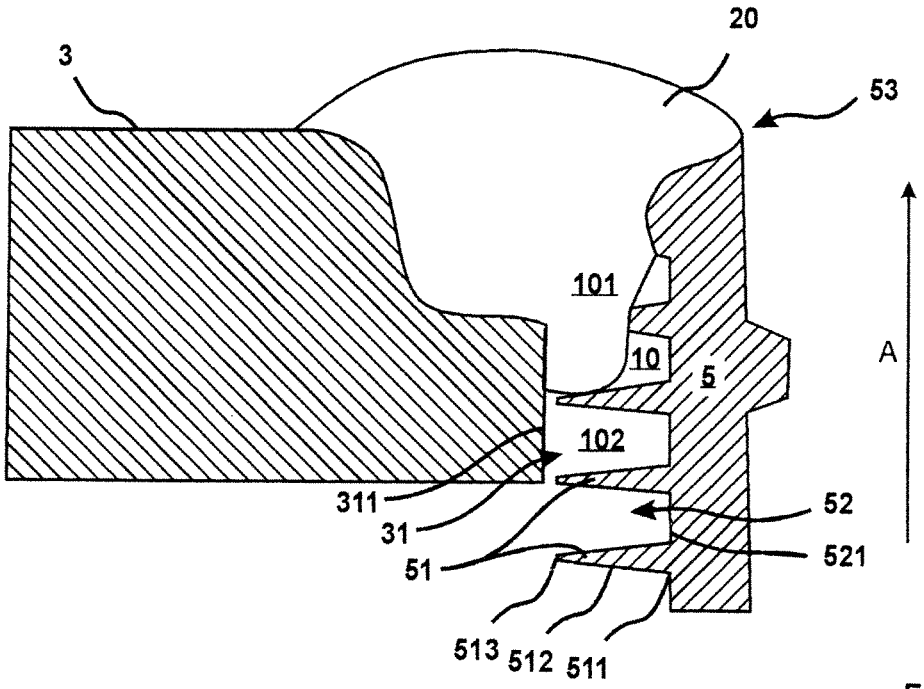
FIG. 4 shows, schematically, a detail view of a section of a material-bonded connection of the tubesheet to a heat exchanger tube.

FIG. 4 shows, schematically, a detail view of a section of a material-bonded connection 20 of the tubesheet 3 to a heat exchanger tube 5. In the embodiment shown, the heat exchanger tube 5 has been inserted in the direction of the tube axis A into the opening 31 formed in the tubesheet 3 and is flush at the end face 53 with the outer surface of the tubesheet.

The heat exchanger tubes 5 have helically circumferential integral fins 51 which are formed on the outside of the tube and have a fin foot 511, fin flanks 512 and a fin tip 513. A channel 52 having a channel bottom 521 is formed between adjacent fins 51. In FIG. 4 there is shown as the material-bonded connection 20 a weld seam, which forms, for example, during laser welding. Welding additives that are suitable in terms of the material are optionally used during the joining. In this way, the material flow and the quantity can also be matched precisely to the desired joint connection. In the case of the material-bonded connection shown, for reasons relating to the process both certain regions of the tubesheet 3 and some outer fins 51 on the heat exchanger tube 5 are also at least partially melted and integrated as joining material 20 as a result of the heat input of a laser. During the joining, the melt, starting from the end face 53, enters the joint gap 10, but is blocked after a certain penetration depth, so that only a first portion 101 of the joint gap 10 at the end face is filled with the involvement of the outer fins 51. Further passage of the melt is prevented by a fin 51 which, owing to the decreasing temperature at the melt front, is no longer melted or flowed around and thus functions as a barrier. In this way, there is a defined flow process of the joining material 20 during the joining operation, which can close the joining point completely at or in the vicinity of the tube end face 53.

The heat exchanger tubes 5 thus have a material-bonded connection 20 to the tubesheet 3, which connection is formed only in a first portion 101 of the opening 31 extending in the axial direction from the end face 53 of a heat exchanger tube 5. A second portion 102 of the opening 31 is not filled with joining material. In the second portion 102, the heat exchanger tube 5 continues to have outer fins 51 on the outside of the tube.

The invention claimed is:

1. A tube bundle heat exchanger, comprising:

an enveloping outer shell;

at least one tubesheet, the outer shell and the at least one tubesheet together defining an interior of the tube bundle heat exchanger;

a tube bundle having a plurality of heat exchanger tubes arranged in the interior and through which a first fluid can flow, the heat exchanger tubes having helically circumferential integral fins formed on an outside of the heat exchanger tube and having a fin foot, fin flanks, a fin tip and a channel having a channel bottom formed between the fins;

at least one inlet at the outer shell for introducing a second fluid into the interior, and at least one outlet at the outer shell for discharging the second fluid from the interior;

wherein:

the at least one tubesheet has openings as passage points, each opening having an inner surface, the heat exchanger tubes project at least with their outer fins into the openings of the at least one tubesheet, and a joint gap is formed in each case between the inner surface of an opening and the outer fins of a heat exchanger tube located inside the opening, the heat exchanger tubes, via joining material and the outer fins, have a material-bonded connection to the at least one tubesheet, the material-bonded connection being formed only in a first portion of the opening extending in an axial direction from an end face of a heat exchanger tube and, in the first portion, the joint gap is filled with joining material so that a second portion of the opening remains, the joint gap not being filled with joining material in the second portion, the heat exchanger tube continuing to have outer fins on the outside of the heat exchanger tube in a region of the second portion.

2. The tube bundle heat exchanger as claimed in claim 1, wherein the first portion filled with joining material accounts for less than 70% of a length of an entirety of the joint gap in the axial direction.

3. The tube bundle heat exchanger as claimed in claim 1, wherein a clear width between the fin tips of a heat exchanger tube and the inner surface of the opening is not more than 30% of a fin height, measured from the channel bottom to the fin tip.

4. The tube bundle heat exchanger as claimed in claim 1, wherein the material-bonded connection is configured to be gas-tight and pressure-resistant.

5. The tube bundle heat exchanger as claimed in claim 1, wherein the heat exchanger tubes have a tube inside diameter in the openings as passage points, the tube inside diameter being is greater than a tube inside diameter of the heat exchanger tubes outside of the passage points.

6. The tube bundle heat exchanger as claimed in claim 1, wherein the heat exchanger tubes are soldered, adhesively bonded or welded into the at least one tubesheet.

7. The tube bundle heat exchanger as claimed in claim 1, wherein the tube bundle heat exchanger includes at least one plenum box arranged at the at least one tubesheet for distributing, diverting or collecting the first fluid.

8. The tube bundle heat exchanger as claimed in claim 1, further comprising support plates disposed to support the heat exchanger tubes.

* * * * *